United States Patent [19]

Hua

[11] Patent Number: 4,840,165

[45] Date of Patent: Jun. 20, 1989

[54] CONTINUOUS SPARK ELECTRONIC IGNITER

[75] Inventor: Wang Hua, Chengdu, China

[73] Assignee: Chengdu Aircraft Corporation, Chengdu, China

[21] Appl. No.: 121,213

[22] Filed: Nov. 16, 1987

[30] Foreign Application Priority Data

Nov. 26, 1986 [CN] China ..... 86107987

[51] Int. Cl.[4] ..... F02P 3/04; F02P 7/067

[52] U.S. Cl. ..... 123/606; 123/617

[58] Field of Search ..... 123/606, 607, 615, 617, 123/619, 637; 315/209 T

[56] References Cited

U.S. PATENT DOCUMENTS

| | | | |
|---|---|---|---|
| 2,953,719 | 9/1960 | Guiot | 123/606 |
| 3,529,587 | 9/1970 | Sasayama | 123/637 |
| 3,550,571 | 12/1970 | Mainprize | 123/619 |
| 3,593,696 | 7/1971 | Guido | 123/607 |
| 4,164,706 | 8/1979 | Akita et al. | 123/615 |

FOREIGN PATENT DOCUMENTS

| | | | |
|---|---|---|---|
| 0142478 | 5/1985 | European Pat. Off. . | |
| 53-17846 | 2/1978 | Japan | 123/606 |

OTHER PUBLICATIONS

"Electronic Equipments for Automobile", The People's Communication Publishing House, Aug. 1985, pp. 175–178 (with translation).

*Primary Examiner*—Andrew M. Dolinar

*Attorney, Agent, or Firm*—Rines and Rines Shapiro and Shapiro

[57] ABSTRACT

The invention relates to a miniature high-energy continuous spark electronic igniter composed of a magnetic pulse generator having a magnetic flux attracting gap, a voltage-stabilizing circuit, a signal amplifying circuit, a two-stage switching circuit, a protection circuit, a voltage-raising output circuit, a trigger signal circuit, an oscillation maintaining control circuit and a trigger signal continuous current circuit. The igniter is adapted to withstand both overload and largely varying supply voltage.

6 Claims, 4 Drawing Sheets

CONTINUOUS SPARK ELECTRONIC IGNITER

TECHNICAL FIELD

The present invention relates to a miniature high-energy continuous spark electronic igniter for igniting fuel in an engine.

BACKGROUND OF THE INVENTION

The conventional electronic igniter is a single spark discharge igniter. Such single spark discharge igniter is being increasingly used in Europe, the U.S., Japan, etc. in order to reduce pollution due to vehicle exhaust. In order to improve the continuity of starting ignition and combustion, the Ford company of the U.S. has recently developed a ferrimagnetic resonant capacitance discharge continuous spark igniting system (c.f. "Electronic Equipments for Automobile", The People's Communication Publishing House, August, 1985, pp. 175–178), which is a program-controlled system and has the advantages of sustained discharging during the period of continuous ignition, long duration of controlling the spark, and high continuation rate of the spark current, etc. These advantages can hardly be reached by conventional electronic igniters. Said program-controlled ferrimagnetic resonant capacitance discharge continuous spark igniting system has a capacitance discharge igniting circuit, a trigger, a strobing oscillator, a power amplifier, and a feedback coil. Its disadvantages lie in that the operational reliability of the circuits is impaired when the supply voltage and the load vary largely; besides, it has complex construction, large volume and high cost.

An apparatus for electronic ignition systems of the multiple spark type is illustrated in the European Patent Application Publication No. 0 142 478. In that apparatus, the pulse generator, the voltage-stabilizing circuit and the signal amplifying circuit are not integally designed, said circuits operate not purely in switching-on or switching-off state, but in linear adjusting state, so that its power consumption and self-heating are larger, while the duration and the reliability of transistors are easily reduced.

SUMMARY OF THE INVENTION

The object of the present invention is to provide a continuous spark electronic igniter, which with respect to the prior art has simple configuration, better timing, small volume, and improved operational reliability in the presence of widely changing supply voltage and load.

According to the present invention, the continuous spark electronic igniter is comprised of a mangnetic pulse generator used as a transducer, a voltage-stabilizing circuit, a signal amplifying circuit, a two-stage switching circuit, a protection circuit, a voltage-raising output circuit, a trigger signal circuit, an oscillation maintaining control circuit and a trigger signal continuous current circuit. According to the present invention, the pulse generator, the voltage-stabilizing circuit and the signal amplifying circuit are integrally designed, and said circuits operate purely in a switching-on or switching-off state, so that power consumption and self-heating are very small, thereby allowing for a very compact construction.

The magnetic pulse generator is a transducer detecting the moving position of the cam on the engine crank. The magnetic pulse generator used in the invented continuous spark electonic igniter has a magnetic flux attracting gap. When the space between the cam and the testing plane of the magnetic pulse generator is just slightly less than that of the magnetic flux attracting gap, the coupling coil outputs a wide high-power pulse signal with high-precision as a main control signal of the circuit, and this signal is sent to the base of a first stage transistor in the signal amplifying circuit. A magnetic conductor I and a magnetic conductor II connected respectively to the two poles of a permanent magnet form the magnetic flux attracting gap in the direction cutting the magnetic flux, and the remaining parts of the magnetic conductor I and the magnetic conductor II are separated from each other by spaces larger than that of the magnetic flux attracting gap. A coupling coil is wound around the magnetic conductor I or around the magnetic conductor II with the direction of the flux as its axial line. Said coupling coil is located between the magnetic flux attracting gap and the testing plane defined by the magnetic conductor I and the magnetic conductor II, and is outside the closed magnetic circuit passing through the magnetic flux attracting gap. One terminal of the coupling coil is connected to the base of the first stage transistor in the signal amplifying circuit, and the other terminal is grounded through a resistor. The magnetic conductor I and the magnetic conductor II provide a magnetic circuit for the flux generated by the permanent magnet, and concentrate the distributed magnetic field, so as to increase greatly the flux density through the magnetic conductor I and the magnetic conductor II. When the space between the cam and the testing plane is still greater than that of the magnetic flux attracting gap, the magnetic circuit is closed through the magnetic flux attracting gap, and no flux penetrates the coupling coil; while at the moment when the space between the cam and the testing plane is just slightly less than that of the magnetic flux attracting gap, the magnetic circuit is immediately switched from the magnetic circuit passing through the magnetic flux attracting gap to that passing through the coupling coil and the tested cam. Consequently, the flux changing rate through the coupling coil is very large, and the coupling coil produces a wide high-power pulse signal with a sharp leading edge and high-precision timing, said pulse signal being transmitted to the base of the first stage transistor in the signal amplifying circuit. Said pulse signal is the main oscillation signal of the circuit.

A stabistor is connected in series with the step-down resistor, the remaining terminals of said stabistor and said resistor are connected respectively to the positive terminal of the power supply and the ground to form a voltage-stabilizing circuit in order to provide a stabilized D.C. power supply for the signal amplifying circuit. There is a filtering capacitor connected between the positive terminal of the stabistor and the ground.

A capacitor connected between the collector of a first stage transistor in the two-stage switching circuit and the negative terminal of a diode in the trigger signal circuit forms a trigger signal continuous current circuit. When the two-stage switching circuit is disabled, said capacitor constituting the trigger signal continuous current circuit is charged, and the charging current will keep an electric signal controlled three-terminal semiconductor switching device in the conductive state for a period of time before it is disabled. By changing the capacitance of the capacitor constituting the trigger signal continuous current circuit, the oscillation frequency of the two-stage switching circuit can also be changed, so that the high-voltage pulse frequency delivered by the continuous spark electronic igniter in accordance with the present invention over the duration of every positive pulse from the magnetic pulse generator will be changed as well. Said high-voltage pulse frequency can also be varied by changing the inductance of the primary winding of the ignition coil or changing the resistance of the resistor connected between the ground and the emitter of a second stage transistor in the two-stage switching circuit, so as to change the output power of the present invention.

According to the invention, the continuous spark electronic igniter uses the magnetic pulse generator having a magnetic flux attracting gap. Said magnetic pulse generator incorporated with the circuitry of said continuous spark electronic igniter gives rise to high reliability as well as sustained forced ignition within the angular range from the beginning of ignition continuously to rotation of the crank by an angle of 30 degrees (may reach a maximum of 45 degrees) over the whole rotating speed band of the engine from 100 to 7000 turns per minute.

This function of the invention can advantageously make the continuous spark electronic ignition energy reach more than 200 MJ, which is four to ten times as much energy as that of the conventional high-energy igniter. Such high ignition energy can ignite dilute mixed gas that is hardly ignited by the ordinary ignition system, and is sufficient to start an engine at a low temperature of −40° C. The normal working temperature of the present invention ranges from −40′ C. to 125° C.

The magnetic pulse generator has two magnetic circuits. One of the closed magnetic circuits is via a magnetic flux attracting gap, and the other passes through the coupling coil and the tested cam. At the moment when the space between the tested cam and the testing plane becomes just greater or smaller than that of the magnetic flux attracting gap, the magnetic circuit will suddenly switch from one circuit to the other, so that the flux changing rate through the coupling coil is very large, and a very strong induction electromotive force is produced to generate a wide pulse signal with a sharp leading edge. So, the intensity and the width of the output signal from the magnetic pulse generator in this invented continuous spark electronic igniter is basically independent of the rotating speed of the tested cam. To compare with that used in the aforesaid ferrimagnetic resonant capacitor discharge continuous spark ignition system developed by the Ford Automobile Company, the magnetic pulse generator of the invention has the advantages of small volume, simple construction, high-precision timing of the produced pulse, strong signal, wide pulse, and an output signal essentially independent of the rotating speed of the tested cam.

According to the invention, the continuous spark electronic igniter gives out a feedback signal from the emitter of the first stage transistor or from the emitter of the second stage transistor in the two-stage switching circuit to control the state of conduction of the electric signal controlled three-terminal semiconductor switching device in order to perform the continuous spark discharge oscillation started from the beginning of each ignition. Such design not only simplifies the construction of the continuous spark ignition electronic igniter, decreases cost, improves reliability, and reduces volume, but also ensures reliable operation even in the case of wide variations of the load and the supply voltage. The reason is that the intensity of the feedback signal taken out from the emitter of the first stage transistor or from the emitter of the second stage transistor in the two-stage switching circuit is independent of load changes. When the load changes violently or even when the output terminal is short-circuited, the two-stage switching circuit is still oscillating over the duration of the pulse signal produced by the magnetic pulse signal generator, and the second stage power transistor still works in a saturation state when it is in a conductive state, so that the power consumption of the power transistor does not increase. This is also a notable advantage of the present invention. Furthermore, the devices in the circuit can not be destroyed by overcurrent because the short-circuit output current is limited by the emitter resistor of the second stage power transistor. When the supply voltage varies within a certain range, the feedback signal current varies accordingly, but the variation of the feedback signal current would only affect the transition time for the electric signal controlled three-terminal semiconductor switching device to change its state from conduction to disabled; it doesn't affect the operational reliability of the circuit. The voltage supply range, which ensures the invented continuous spark electronic igniter with reliable function, is from a maximum of 30 V. to a minimum of 5 V. This is six times in ratio, so that said continuous spark electronic igniter operates reliably in the case of wide change of load and severe variation of supply voltage.

Since the magnetic pulse generator used in this invented continuous spark electronic igniter has a small volume and a simple circuit design, all elements in said igniter with the exception of the ignition coil can be integrated into an independent small unit and assembled directly into an ignition distributor without the need of changing the latter. It is adapted to various automobile engines, turbine engines and rocket engines for ignition. The prior art electronic ignition systems, both single spark and continuous spark, can not be assembled wholly into the ignition distributor because of their large volume.

The present invention and the embodiments thereof will with reference to the drawings be described in detail below.

DETAILED DESCRIPTION OF THE INVENTION

Figure 1:
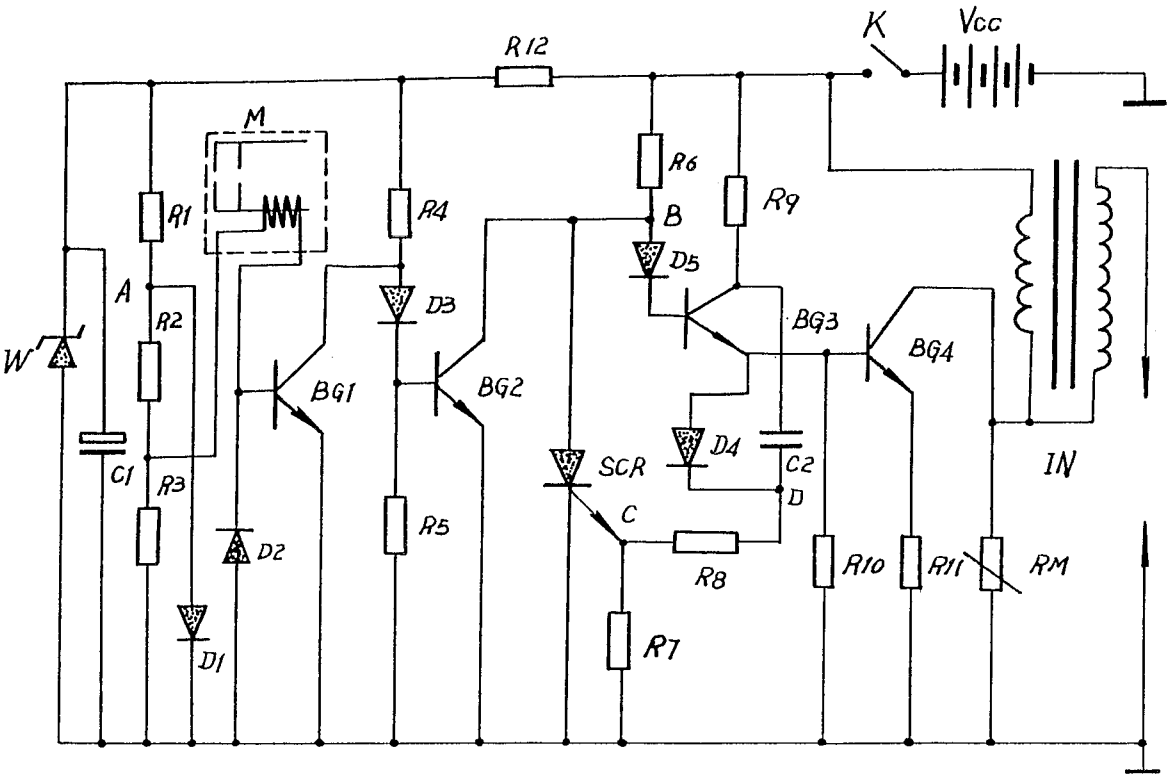
FIG. 1 is the schematic circuit diagram of a continuous spark electronic igniter.

Referring to FIG. 1, the system of the present invention includes a signal amplifying circuit having two N-P-N transistors—specifically, a first stage transistor BG1 and a second stage transistor BG2.

The signal amplifying circuit is consisted of two N-p-N transistors. There is a clamping diode D1 which is connected between the ground and the point A. The point A is in the voltage-dividing bias circuit of the first stage transistor BG1 of the signal amplifying circuit, in order to disable the first stage transistor reliably, since the emitter junction is reverse-biased when no signal is inputted to said first stage transistor. There is a diode D3 positively connected in series between the collector of the first stage transistor BG1 and the base of the second stage transistor BG2 in order to disable the second stage transistor reliably when the first stage transistor is in a conductive state. There is a diode D2 reversely connected in series between the base of the first stage transistor of the signal amplifying circuit and the ground. The positive terminal of said diode is connected with the ground and the negative terminal of said diode is connected to the base of the first stage transistor so as to provide a closed path for the negative pulse delivered from the coupling coil.

The two-stage switching circuit also comprises two N-P-N transistors first and second stage transistors BG3 and BG4. The first stage transistor is an emitter follower with strong loading ability and its emitter is directly coupled to the base of the second stage transistor. There is a diode D5 connected in series between the base of the first stage transistor and the bias resistance R6 to form a bias circuit for the the first stage transistor BG3. The point B, which is the junction of the diode positive terminal, the bias resistance, the collector of the second stage transistor BG2 in the signal amplifying circuit, and the controlled current input terminal of an electric signal controlled three-terminal semiconductor switching device SCR, is the oscillation control terminal. The purpose of connecting this diode serially is to increase the voltage level of the control terminal B. Thus, when the second stage transistor in the signal amplifying circuit or the electric signal controlled three-terminal semiconductor switching device is in the conductive state, the voltage level of the control terminal B is less than the sum of the serial positive voltage-drop caused by the conducting diode in the first stage transistor bias circuit of the two-stage switching circuit, the conducting first stage transistor and the conducting second stage transistor. Then the two-stage switching circuit is disabled. There is a varistor RM which is connected between the collector of the second stage transistor in the two-stage switching circuit and the ground to form a protection circuit for protecting the second stage transistor.

An ignition coil IN forms a voltage-raising output circuit. The primary winding L1 of the ignition coil is connected in series between the positive pole of a power supply Vcc and the collector of the second stage transistor BG4 in the two-stage switching circuit. One terminal of the secondary winding L2 is also connected to the collector of the second stage transistor in the two-stage switching circuit and the other terminal is the output. When the two-stage switching circuit is changed from a conductive state to a disabled state, the electric current in the primary winding of the ignition coil is interrupted suddenly to produce a strong continuous electromotive force, so that the secondary winding will output a high-power pulse voltage.

The trigger signal circuit comprises a diode D4 in series with two voltage-dividing resistances R7 and R8. The positive pole of the diode is the signal current input of the trigger signal circuit, and is connected to the emitter of the first stage transistor or to that of the second stage transistor in the two-stage switching circuit, in order to extract a signal current to be used as the trigger conduction control signal for the electric signal controlled three-terminal semiconductor switching device SCR. The other terminal of the trigger signal circuit is connected to the ground.

The electric signal controlled three-terminal semiconductor switching device forms an oscillation maintaining control circuit. The controlled-current input terminal of the electric signal controlled three-terminal semiconductor switching device is connected to the oscillation control terminal B. The controlled-current output is connected to the ground. The control terminal and the junction of the two voltage-dividing resistances in the trigger signal circuit are connected together at point C. When the second stage transistor in the signal amplifying circuit is in a disabled state, the oscillation maintaining control circuit will, under the control of the trigger signal, make the two-stage switching circuit oscillate repeatedly between the conductive and disabled state, so that the secondary winding of the ignition coil will output a continuous pulse with high voltage, whereby a continuous discharge spark is produced in the ionized plasma zone of the spark plug gap to ignite continuously the mixed gas in the engine combustion chamber. An ordinary thyristor or an interruptable thyristor or a transistor may be used as said electric signal controlled three-terminal semiconductor switching device. When using an ordinary thyristor as the electric signal controlled three-terminal semiconductor switching device, the current flowing into the ordinary thyristor anode is less than the maintenance current of the ordinary thyristor. When using an ordinary thyristor or an interruptable thyristor, the anode thereof is connected to the first stage transistor bias circuit in the two-stage switching circuit at point B, the cathode thereof is connected with the ground, and the control terminal thereof is connected to the trigger signal circuit at point C. When using an N-P-N transistor as the electric signal controlled three-terminal semiconductor switching device, the collector thereof is connected at point B with the first stage transistor bias circuit in the two-stage switching circuit, the emitter thereof is connected to the ground, and its base to the trigger signal circuit at point C. When using a P-N-P transistor as the electric signal controlled three-terminal semiconductor switching device, the emitter thereof is connected at point B with the first stage transistor bias circuit in the two-stage switching circuit, the collector thereof to the ground, and the base thereof to the trigger signal circuit at point C.

Figure 2:
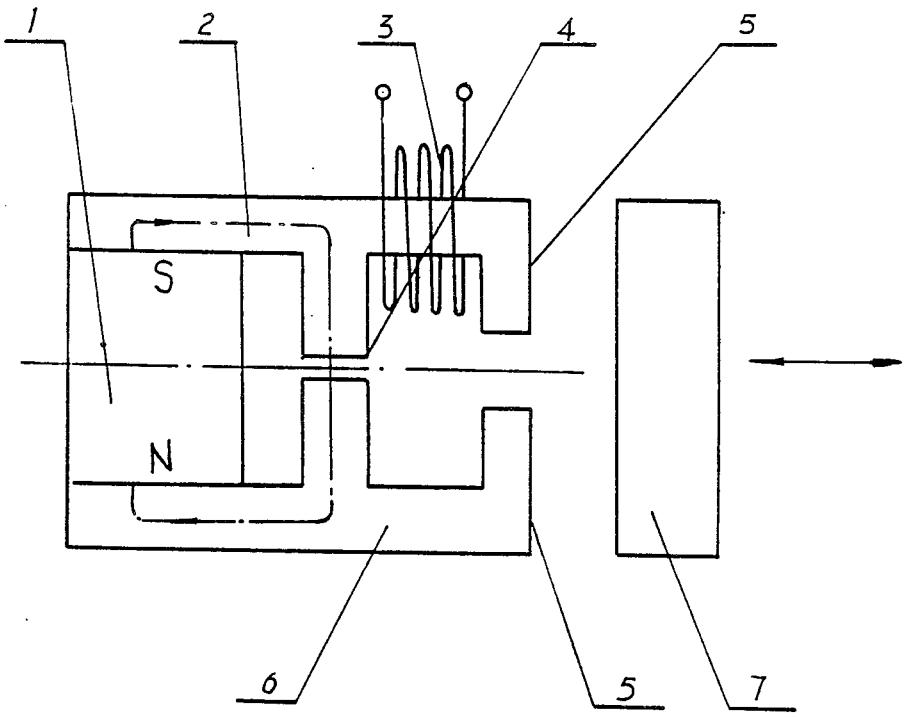
FIG. 2 is the schematic diagram illustrating the construction of the magnetic pulse generator for the continuous spark electronic igniter.

Referring to FIG. 2, the magnetic pulse generator will now be described.

The magnetic conductor I(2) and the magnetic conductor II(6) are connected to the S and N pole of the permanent magnet (1) respectively to form a magnetic circuit for concentrating the distributed magnetic field so as to increase largely the flux density through the magnetic conductor I(2) and the magnetic conductor II(6). Said magnetic conductor I(2) and said magnetic conductor II(6) form a magnetic flux attracting gap (4) along the direction which cuts the flux delivered by the permanent magnet (1). The distances across said magnetic flux attracting gap (4) is from 0.5 mm to 1.5 mm. The remaining parts of the magnetic conductor I(2) and the magnetic conductor II(6) are separated from each other by distances greater than that across the magnetic flux attracting gap (4). A coupling coil (3) is wound around the magnetic conductor I(2) with the direction of the flux generated by the permanent magnet (1) as its axial line. Said coupling coil is located between the magnetic flux attracting gap (4) and a testing plane (5) defined by the magnetic conductor I(2) and II(6), and is outside the magnetic circuit closed through the magnetic flux attracting gap (4). At the moment when the space between a tested cam (7) and the testing plane (5) is less than that of the magnetic flux attracting gap (4), the closed magnetic circuit is rapidly switched from that closed via the magnetic flux attracting gap (4) to that closed by passing the flux through the coupling coil (3) and the tested cam (7). As the rate of change of flux through the coupling coil (3) is very large, a strongly induced electromotive force is produced in the coupling coil (3) which generates a wide pulse signal with a sharp leading edge. The coil (3) outputs a positive pulse signal, which is then impressed through the resistor R3 on the connection between the base and emitter of the preceding stage transistor BG1 in the signal amplifying circuit. At the moment when the space between the tested cam (7) and the testing plane (5) is greater than that of the magnetic flux attracting gap (4), the magnetic circuit closed through the tested cam (7) is switched immediately to the magnetic circuit which passes through the magnetic flux attracting gap (4). Similarly, this will produce a very strongly induced electromotance in the coupling coil, but in the opposite direction. The negative output pulse flows through the resistor R3 and the diode D2. A stabistor W is in series with a step-down resistor R12 to form a voltage-stabilizing circuit, of which one terminal is connected with the positive pole of power supply Vcc via a switch K, and the other is connected with the ground. Capacitor C1 is connected across the two terminals of said stabistor W which is of the type 2CW7 in this embodiment.

Thus, to recapitulate, the collector of the transistor BG1 is connected to the base of the transistor BG2 via a diode D3 to form a signal amplifying circuit. Resistors R1, R2 and R3 are connected in series to form the voltage-dividing bias circuit for the transistor BG1, and a diode D1 for clamping is connected between point A and the ground, where point A is the junction point of resistors R1 and R2. Resistor R4, diode D3 and resistor R5 are series connected to form a voltage-dividing circuit which provides current for the base of the transistor BG2 to ensure the transistor reaches a state of saturated conduction, when the transistor BG1 is in disabled state. The resistor R6 is a current-limiting resistor for the transistor BG2 and the interruptable thyristor SCR, which is used as the electric signal controlled three-terminal semiconductor switching device. Resistor R6 is the bias resistor for the transistor BG3 in the two-stage switching circuit as well. In the present embodiment, type 3DK7 and type 3DK9 are used respectively for the transistors BG1 and BG2.

The emitter of the transistor BG3 is directly connected with the base of the transistor BG4 to form a two-stage switching circuit. The diode D5 is serially connected between the bias resistor R6 and the base of the transistor BG3. Diode D5, bias resistor R6, the collector of the transistor BG2, and the controlled-current input terminal of the electric signal controlled three-terminal semiconductor switching device are jointly connected at point B to form the oscillation control terminal. In the present embodiment type 3DK9 is used for the transistor BG3, and type 3DD15 for the transistor BG4.

There is a varistor RM connected between the collector of the transistor BG4 and the ground to form a protection circuit for the transistor BG4.

The primary winding L1 of the ignition coil 1N is serially connected between the positive pole of the power supply and the collector of the transistor BG4. One terminal of the secondary winding L2 is connected to the collector of the transistor BG4 and the other is an output terminal.

The resistors R7, R8 and the diode D4 are series connected, with one end of R7 grounded, and one end of D4 connected to the emitter of the transistor BG3 to form a trigger signal circuit.

The electric signal controlled three-terminal semiconductor switching device forming the oscillation maintaining control circuit is an interruptible thyristor SCR. The anode of the interruptible thyristor is connected with the oscillation control terminal B, and its cathode is connected with the ground. The control terminal of the SCR is connected at point C to the junction of the resistors R7 and R8 in the trigger signal circuit.

There is a capacitor C2 connected between the collector of the transistor BG3 and the junction D, wherein point D is the junction point of the negative pole of the diode D4 and the resistor R8 in the trigger signal circuit, so as to form a trigger signal continuous current circuit.

The operating process of this embodiment is as follows: When the power switch K is closed, the voltage-stabilizing circuit supplies stabilized voltage providing a DC voltage of 5 V for the signal amplifying circuit. When the magnetic pulse generator M doesn't generate a positive pulse signal, for the clamping of the diode D1, the transistor BG1 is disabled reliably, while the transistor BG2 gets base current through its bias circuit and is in a state of saturated conduction. In addition, the voltage level of the oscillation control terminal B decreases to 0.7 volts, which is less than the position serial saturated step-down voltage of the diode D5 and the transistors BG3 and BG4, so that the transistors BG3 and BG4 are disabled. As a result no current flows through the primary winding L1 of the ignition coil, and no voltage is output from the secondary winding L2.

At the moment when the gap between the tested cam (7) and the testing plane (5) is just less than that of the magnetic flux attracting gap (4), the coupling coil (3) of the magnetic pulse generator M generates a positive pulse signal impressed on the base of the transistor BG1 to force the transistor BG1 to a state of saturated conduction. The transistor BG2 suddenly changes its state from conduction to disabled, and the voltage level at control terminal B increases rapidly, and is greater than the serial positive conduction step-down voltage of the diode D5 and the transistors BG3 and BG4. So that the transistors BG3 and BG4 are in the state of saturated conduction, the current passing through the primary winding L1 of the ignition coil is increasingly growing against the inductive impedance. When the emitter voltage level of the transistor BG4 steps up to about 0.7 volts (if the anode of the diode D4 is connected with the emitter of the transistor BG4, the emitter voltage level should increase to about 1.4 volts), the interruptable thyristor goes into a conductive state, and its anode voltage decreases to about 1.5 volts. This is less than the positive serial conduction step-down voltage of the diode D5 and the transistors BG3 and BG4, so that the transistors BG3 and BG4 are disabled, the current passing through the primary winding L1 of the ignition coil IN is suddenly interrupted, the continuous induction electromotive force increases abruptly, through coupling, and the secondary winding L2 outputs a high-voltage pulse. After disablement of the transistor BG3, the capacitor C2 is charged and part of the charging current flows to the control terminal of the interruptible thyristor SCR, so as to keep it in a state of conduction for a certain period of time before it is disabled. After disabling of the interruptible thyristor, the voltage level at the anode thereof jumps to a value which is greater than the positive serial saturated conduction step-down voltage of the diode D5 and the transistors BG3 and BG4, so that the transistors BG3 and BG4 are again placed in conductive state, and the current again flows into the primary winding L1 of the ignition coil. Such oscillation process repeats again and again, and the secondary winding L2 of the ignition coil outputs successive high-voltage pulses, whereby successive discharge sparks are generated in the gap of the spark plug. Such oscillation will not stop until the positive pulse signal generated by the magnetic pulse generator M disappears. When the magnetic pulse generator M produces a positive pulse signal once more, such oscillation will be started again.

When the trigger signal is taken from the emitter of the first stage transistor BG3 in the two-stage switching circuit, the resistance R11 can be calculated according to the second formula:

$$R11 = \frac{0.7 \times RL1}{VCC\text{-}1.4}\ (\Omega)$$

When the trigger signal is taken from the emitter of the following stage transistor BG4, the resistance R11 can be calculated according to the following formula:

$$R11 = \frac{0.7 \times RL1}{VCC\text{-}2.1}\ (\Omega)$$

in which:

RL1 is the resistance of the primary winding L1 of the ignition coil in ohms, and Vcc is the power supply voltage.

In the present embodiment, the resistance of R1, R2, R3, R4, R5, R6, R7, R8, R9, R10, R11, and R12 are 1 KΩ, 51 Ω, 30 Ω, 4.3 KΩ, 1 KΩ, 1 KΩ, 100 Ω, 39 Ω, 27 Ω, 510 Ω, 10.35 Ω, 680 Ω respectively. The capacitance of C1 and C2 are 2.2 μF, 0.1 μF respectively. The diodes D1, D2, D3, D4, and D5 are 2CP1, 2CP1, 2CP1, 2CZ53, 2CP3 respectively. The interruptible thyristor SCR is 3CTG05A, the varistor is MY31-300 V, 1000 A, and the variable range of the power supply voltage is 5 V–30 V.

Figure 3:
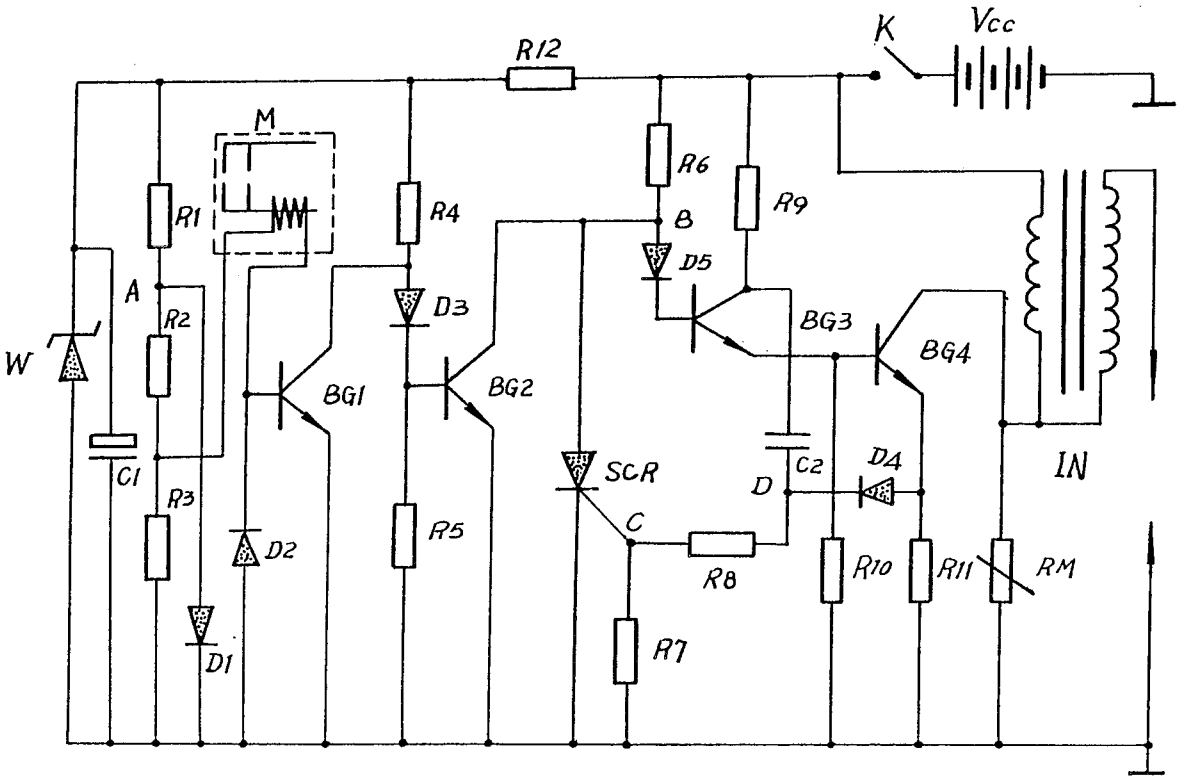
FIGS. 3 and 4 are schematic diagrams of additional embodiments of the igniter.

Other embodiments of the present invention will be described below:

According to a second embodiment shown in FIG. 3, the junction point between the positive pole of the diode D4 and the emitter of the transistor BG3 of the FIG. 1 embodiment can be eliminated and the positive pole of said diode D4 connected to the emitter of the other transistor BG4. If desired, resistor R8 connecting with the point C can also be or taken out.

Figure 4:
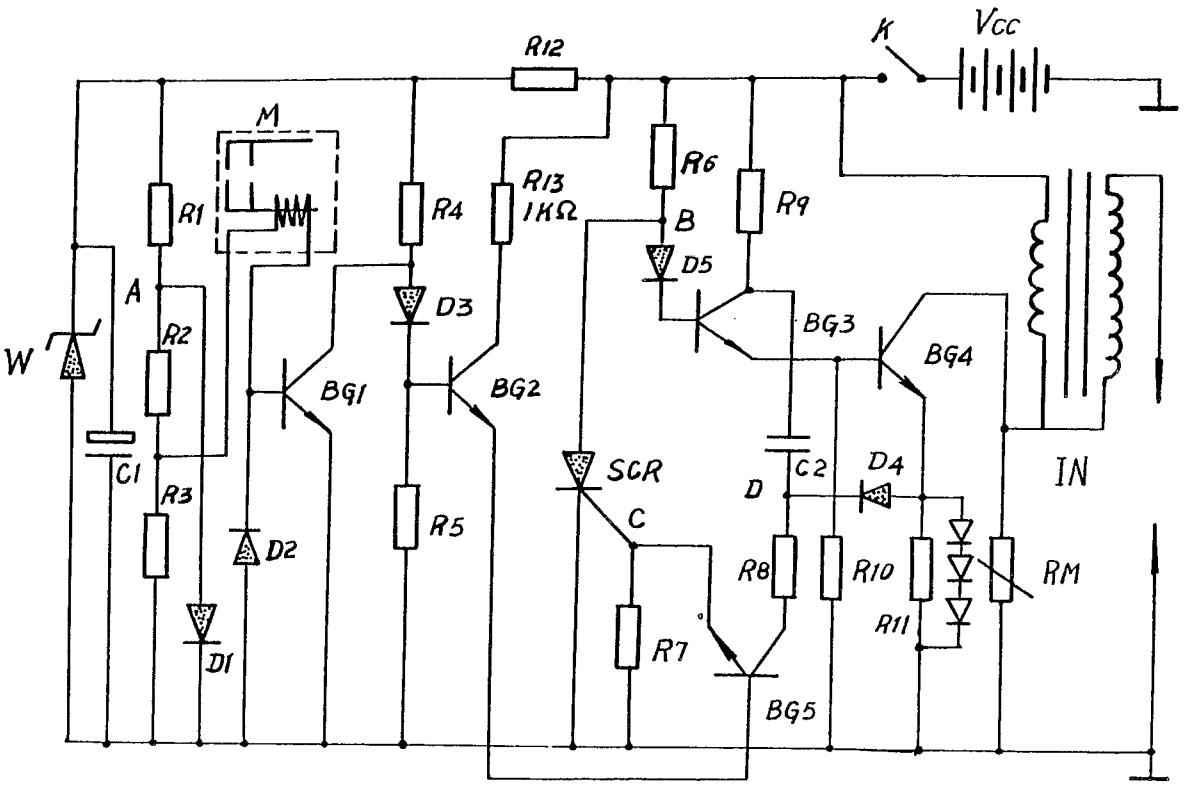

According to a third embodiment, shown in FIG. 4, an N-P-N transistor is added to the circuit. Its emitter is connected with the point C, the collector thereof is connected with the resistor 8 or the point D if said resistor R8 is taken out, and the base thereof is connected with the emitter of the transistor BG2, replacing the ground connection. The collector of the transistor BG2 is interrupted from the point B, and with a resistor is connected with the positive pole of the power supply. A series of three rectifier diodes in same direction is connected between the emitter of the transistor BG4 and the ground. Its positive pole is connected to the emitter of the transistor BG4, and the negative pole is grounded. A stabistor of 2.1 V and a varistor may be used in this case for clamping voltage.

A stabilizing diode and a resistor of about 100 Ω may be serially connected between the power supply and the point C, with the positive pole of said stabilizing diode connected to the point C, in order to prevent the instantaneous changing voltage of over 30 V influences the pulse generating circuit.

I claim:

1. A continuous spark electronic ignition, comprising:

a. magnetic pulse generator means for providing an electric pulse signal in accordance with the rotational position of an engine crank, b. signal amplifying circuit means having an input connected to an output of said magnetic pulse generator means for amplifying said electric pulse signal, c. voltage stabilizing circuit means having an input connected to a power supply and an output connected to said magnetic pulse generator means and said signal amplifying circuit means for providing stabilized input voltages to said magnetic pulse generator means and said signal amplifying circuit means, and d. continuous pulse generating circuit means having an oscillation control input connected to an output of said signal amplifying circuit means for generating a corresponding continuously pulsed output voltage signal in response to each pulse input from said signal amplifying circuit means, said magnetic pulse generator means including a permanent magnet, a first magnetic flux conductor and a second magnetic flux conductor connected respectively to opposite poles of said permanent magnet and defining a normally closed first magnetic circuit and a normally open second magnetic circuit, said first magnetic circuit being closed through a magnetic flux attracting gap of from about 0.1 mm to about 5 mm defined between the closest parts of said first and second magnetic flux conductors, said second magnetic circuit having a magnetic detecting surface spaced from said first magnetic circuit, and a coupling coil wound about a portion of one of said first and second magnetic flux conductors in said second magnetic circuit and between said first magnetic circuit and said magnetic detecting surface, said continuous pulse generating circuit means including directly coupled two-stage transistor switching circuit means having an output connected to an ignition coil and a resistance connecting the emitter of a second stage transistor of said switching circuit means to ground, oscillation maintaining and control circuit means including a three-terminal semiconductor switching device having a controlled-current input connected to a first stage transistor bias circuit of said switching circuit means for causing said switching circuit means to oscillate between enabled and disabled states, trigger signal circuit means having an input connected to the emitter of one of said first and second stage transistors of said switching circuit means and an output connected to a control input of said three-terminal semiconductor switching device for causing said three-terminal semiconductor switching device to conduct and disable said switching circuit means and to stop conducting after said switching circuit means is disabled, and trigger signal continuous current circuit means having an input connected to the collector of said first stage transistor of said switching circuit means and an output connected to an input of said trigger signal circuit means for causing said three-terminal semiconductor switching device to remain conductive for a period of time after said switching circuit means is disabled.

2. A continuous spark electronic ignition according to claim 1, wherein said bias circuit of said first stage transistor includes a resistor and a diode connected in series between the base of said first stage transistor and a positive terminal of said power supply, the collector of said first stage transistor is connected to said positive terminal of said power supply by a resistor, the emitter of said first stage transistor is connected to ground by a resistor and connected directly to the base of said second stage transistor, the collector of said second stage transistor is connected to ground by a voltage sensitive resistor and to said positive terminal of said power supply by a primary winding of said ignition coil, and said three-terminal semiconductor switching device has a controlled-current output connected directly to ground and said controlled-current input thereof connected to a junction of said resistor and said diode of said bias circuit of said first stage transistor.

3. A continuous spark electronic ignition according to claim 2, wherein said trigger signal circuit means includes a diode, a first resistor, and a second resistor, said diode has an anode connected to the base of said second stage transistor and a cathode connected to a first terminal of said first resistor, a second terminal of said first resistor is connected to said control input of said three-terminal semiconductor switching device and to a first terminal of said second resistor, a second terminal of said second resistor is grounded, and said oscillation control input of said continuous pulse generating circuit means is constituted by said controlled-current input of said three-terminal semiconductor switching device.

4. A continuous spark electronic ignition according to claim 2, wherein said trigger signal circuit means includes a diode, a first resistor, and a second resistor, said diode has an anode connected to the emitter of said second stage transistor and a cathode connected to a first terminal of said first resistor, a second terminal of said first resistor is connected to said control input of said three-terminal semiconductor switching device and to a first terminal of said second resistor, a second terminal of said second resistor is grounded, and said oscillation control input of said continuous pulse generating circuit means is constituted by said controlled-current input of said three-terminal semiconductor switching device.

5. A continuous spark electronic ignition according to claim 2, wherein said trigger signal circuit means includes a diode, a first resistor, a second resistor, and a control transistor, said diode has an anode connected to the emitter of said second stage transistor and a cathode connected to a first terminal of said first resistor, said first resistor has a second terminal connected to the collector of said control transistor, the emitter of said control transistor is connected to a first terminal of said second resistor and to said control input of said three-terminal semiconductor switching device, a second terminal of said second resistor is grounded, and said oscillation control input of said continuous pulse generating circuit means is constituted by said control input of said semiconductor switching device.

6. A continuous spark electronic ignition according to claim 2, wherein said three-terminal semiconductor switching device is a thyristor means and the current flow into the controlled-current input of said thyristor means is less than the maintenance current of said thyristor means.

* * * * *